US011221189B1

(12) United States Patent
Couvillion

(10) Patent No.: US 11,221,189 B1
(45) **Date of Patent: *Jan. 11, 2022**

(54) METHOD AND APPARATUS FOR PARALLEL PATH FIREARM SOUND SUPPRESSION

(71) Applicant: Roy J. Couvillion, Lafayette, LA (US)

(72) Inventor: Roy J. Couvillion, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/859,543

(22) Filed: Apr. 27, 2020

Related U.S. Application Data

(63) Continuation-in-part of application No. 15/875,647, filed on Jan. 19, 2018, now Pat. No. 10,634,444.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41H 21/30
USPC ..... 89/14.4; 181/223
See application file for complete search history.

(56) References Cited

U.S. PATENT DOCUMENTS

| | | | | |
|---|---|---|---|---|
| 7,931,118 | B1 * | 4/2011 | Cronhelm | F41A 21/30 181/223 |
| 8,307,946 | B1 * | 11/2012 | Johnston | F41A 21/30 181/223 |
| 9,599,421 | B1 * | 3/2017 | Dean | F41A 21/30 |
| 10,634,444 | B2 * | 4/2020 | Couvillion | F41A 21/30 |
| 2011/0132683 | A1 * | 6/2011 | Miller | F41A 21/30 181/223 |
| 2017/0102201 | A1 * | 4/2017 | Bush | F41A 21/30 |

* cited by examiner

*Primary Examiner* — Bret Hayes
(74) *Attorney, Agent, or Firm* — Ted M. Anthony; Sarah B. Dupont

(57) ABSTRACT

A method of firearm sound and flash suppression, and a device to facilitate that method, by preventing a plurality of solid propellant particles from suspending, and separating solid propellant particles from suspension, within a plurality of gases ejected from a firearm muzzle. The method comprises temporarily detaining the solid propellant particles to burn within the device while allowing gases to flow through and exit the device with minimal turbulence and resistance. The method and the device allow the bullet to move away from the propellant solids and gases, thereby minimizing the effects of asymmetrical forces produced by the propellant solids and gases. The device comprises a plurality of features that are organized in a manner to direct the flow of gases exiting said device in a direction co-linear to the path of the bullet.

28 Claims, 16 Drawing Sheets

Section A-A

Section E-E

Section D-D

Section C-C

Section B-B

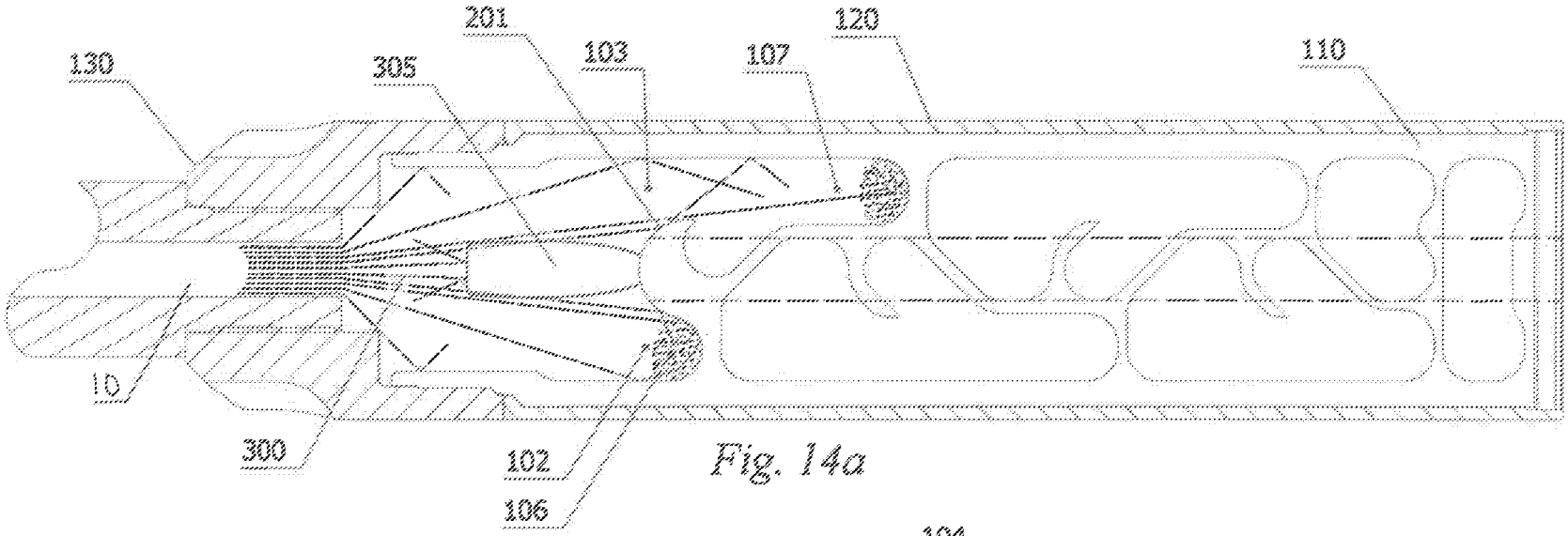
Fig. 14a
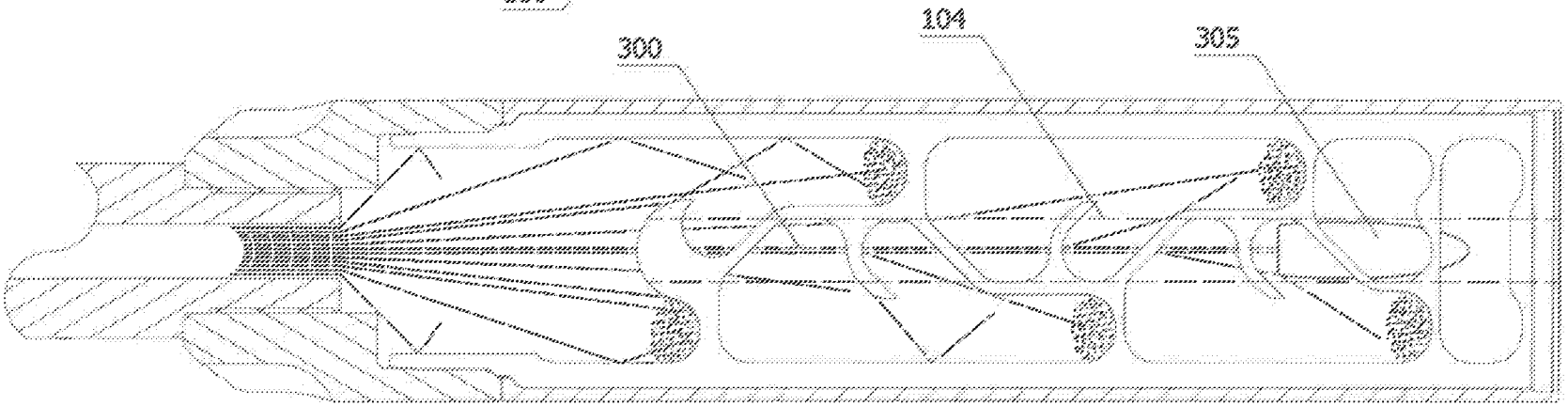
Fig. 14b
Fig. 14

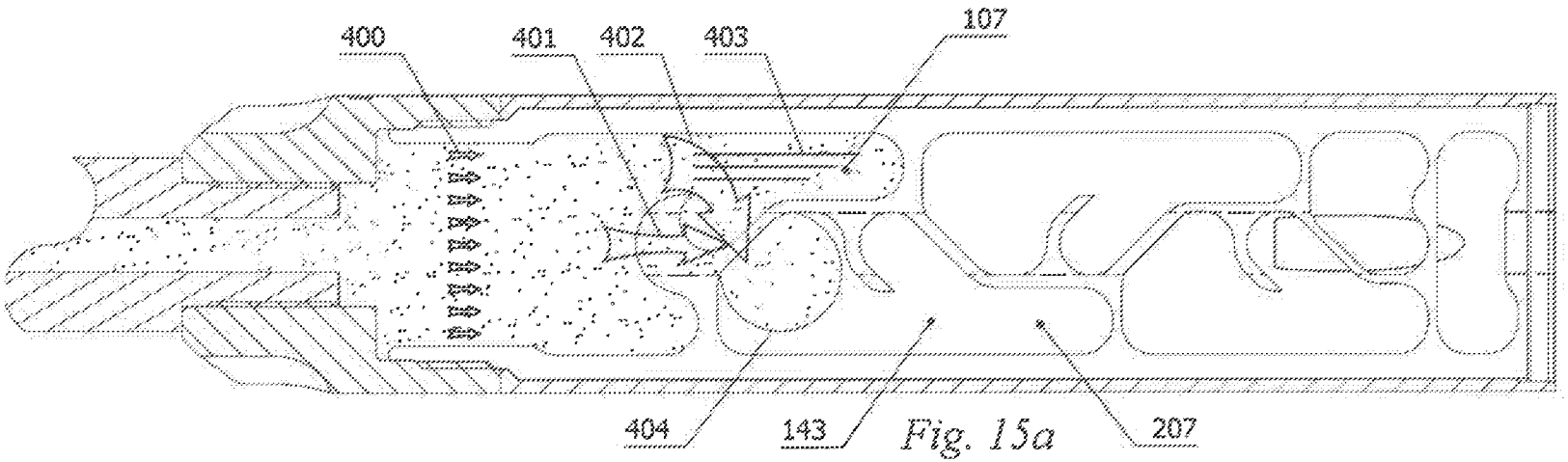
Fig. 15a
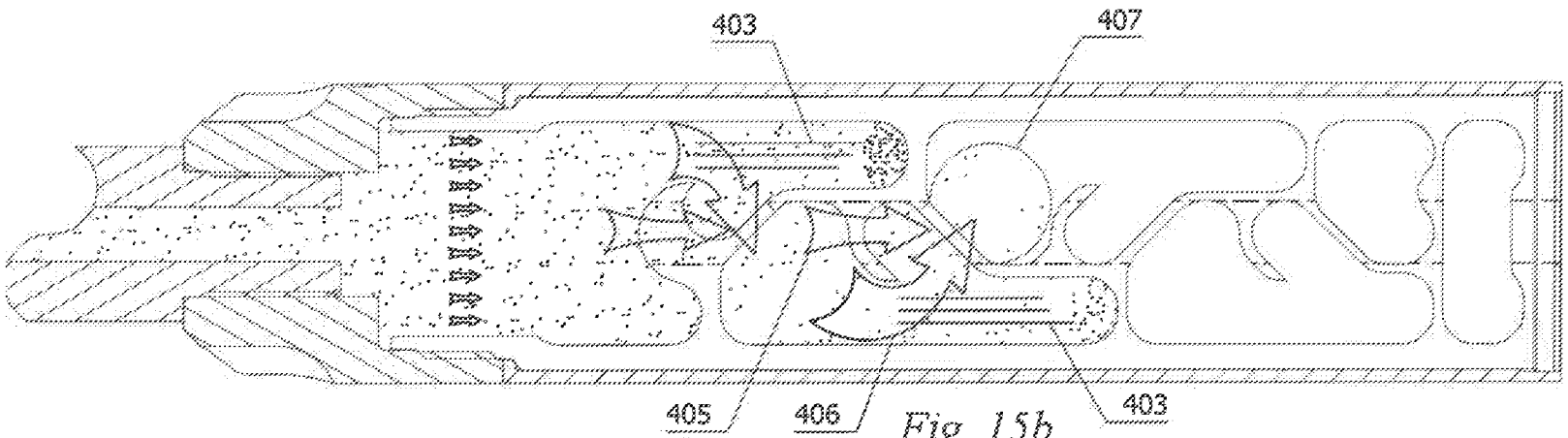
Fig. 15b
Fig. 15

METHOD AND APPARATUS FOR PARALLEL PATH FIREARM SOUND SUPPRESSION

BACKGROUND OF THE PRESENT INVENTION

1. Field of the Invention

The present invention pertains to a method and a device for firearm sound suppression. Specifically, the method comprises a means for detaining solid unburned propellant particles to burn within a suppressor, and removing solid unburned propellant particles from suspension with a plurality of gases and detaining those particles to burn within the suppressor. The device of the present invention facilitates the method.

2. Description of Related Art

Firearm sound suppressors, commonly referred to as silencers or suppressors, are used to reduce the sound of a firearm muzzle blast. Devices of common prior art methods contain the solid propellant particles and explosive expansion of gases released from a firearm barrel, and incite turbulence to keep the particles suspended in the gases in a gas-solid suspension, and to slow the rate of flow of the gas-solid suspension through the device. These devices provide time and space within which the solid propellant particles continue to burn and generate gases, and within which the gases more completely burn, expand and cool before being discharged to the atmosphere. Suppressors employing the method described in U.S. Pat. No. 916,855 to Maxim (hereinafter referred to as "Maxim") divide a container volume into chambers with a plurality of baffles wherein the container and baffles have coaxial holes defining a bullet pathway. Gases expanding as the gas-solid suspension progresses through these holes into subsequent chambers generate turbulence which helps to maintain the propellant particles in suspension and facilitates the suspension of propellant particles not in suspension. This turbulence reduces the rate of flow of the gas-solid suspension providing additional time within which the solid propellant particles continue to burn and generate gases, and within which the gases more completely burn, expand and cool before being discharged to the atmosphere.

Common approaches for improving performance include increasing the cross-sectional area and/or the length of the device, increasing the number of baffles, decreasing the cross-sectional area of the bullet pathway hole in the baffles or end cap of the device, using baffle geometries intended to increase turbulence, and other means to further delay the flow of the gas-solid suspension and burning gases through the device.

In each of these approaches to improve Maxim's design, the consistent objective is to maximize the amount of time the gas-solid suspension and burning gases remain in the device. Also, in each of these approaches, the process is sequential in that the gases and the suspended solid propellant move concomitantly within each chamber while, within each chamber, some of the solid propellant burns and converts to gas thus increasing the amount of gas and decreasing the amount of solid propellant moving to the subsequent chamber where the process repeats with progressively less unburned solid propellant and progressively more gases until leaving the last chamber and exiting the device with a minimal amount of solid propellant, a minimal amount of burning gases, and a maximum amount of cooled propellant gases. This is consistent with what is commonly referred to as the "Maxim method" which is accepted as the "normal and logical manner in which" such devices operate.

U.S. Patent Application Publication No. 2011/0132683 A1 to Miller et al. (hereinafter referred to as "Miller") demonstrates a device to facilitate this method. Such devices easily disassemble to facilitate cleaning. While Miller recognizes the incidental deposition of solids such as lead, copper, and carbonized propellant residue, Miller does nothing to demonstrate any intention of the design to separate solid propellant from suspension. Also, while Miller identifies fluid flow paths terminating in isolated areas and volumes, Miller does not mention or infer any intention for solid propellant to be directed through the paths and toward the isolated areas or volumes, Rather, Miller anticipates lead deposition as an incidental and undesirable consequence of the process. Miller repeatedly cites that the " . . . plurality of chambers, the plurality of recesses, and the path are configured to allow propellant gases to travel there through" and does not mention the intentional detention of propellant solids that anywhere in the specification.

U.S. Pat. No. 7,931,118 to Cronhelm (hereinafter referred to as "Cronhelm") teaches a suppressor baffle with multiple faces divided by a joining wall to " . . . provide for additional expansion chambers between" baffle faces into which propellant gases would be diverted. In the plurality of instances cited in the specification, Cronhelm's "joining wall" joins two separate baffle distal and proximal faces. Portions of some baffle faces are cut to form "cut-off chords" allowing an alternate route for gases to flow. Cronhelm explains. "This mixing together of the two gas flows creates turbulence and subsequent delaying of the forward passage of the gases," Throughout the specification Cronhelm describes the intention of the invention to create turbulence and delay the gas flow and slow the expansion of gases. This too, is consistent with the "normal and logical manner in which" such devices operate.

It is known that wetting the inside of a suppressor with water or with other materials commercially referred to as ablative media can significantly improve the performance of suppressors. While the intended effect is that the ablative media helps to cool propellant gases, it is easily demonstrated that the media captures and extinguishes some solid burning propellant. This temporary improvement remains until the media is consumed or has evaporated. This suggests that introducing a means to remove solids from the gas-solid suspension can improve suppressor performance.

A detrimental effect of the use of firearm suppressors is the increase of backpressure within the firearm. Methods and devices of prior arts improve sound attenuation and reduce muzzle blast by delaying the flow of gases and influencing turbulence to suspended solid propellant through the device. This, by definition, creates an increase of pressure upstream of the flow. Increased pressure in weapons with gas-operated systems can cause smoke and particle blow-back which can adversely affect the shooters ability to perform and can be medically harmful. Also, increased pressure can adversely affect gas operated systems which can cause system failures Another detrimental effect of the use of firearm suppressors is the reaction of the muzzle with respect to gas ejection from the suppressor causing the weapon to divert from the intended point of aim. This requires the shooter to take additional time to re-acquire the target before proceeding. This "muzzle flip" or "muzzle jump" or "muzzle rise" is often a reaction to the force of gases leaving the muzzle in a direction other than co-linear to the bullet pathway. When this is the case, the user can sometimes radially index the suppressor to the host weapon in an attempt to mitigate the effect.

It is also known that the use of a suppressor on a firearm often changes the point of impact (POI) of the bullet as compared to the point of impact without the use of a suppressor. One cause of this POI shift is the asymmetry of forces the bullet encounters as it travels through and leaves the device.

In practical use, the adverse effects of a suppressor on the operation of the host firearm can outweigh the need to reduce sound or muzzle flash. Increasing size and weight to decrease backpressure or improve performance is often a limited option for some applications.

This describes a need for a method other than the "normal and logical manner" and a device to facilitate the method that can provide sound attenuation and flash reduction with minimal backpressure, with minimal cross-sectional size, and with minimal length, and that there exists a need for a means to do so without the use of a consumable ablative media. Also described are needs for a method and device to minimize asymmetrical forces around the bullet which might adversely affect bullet stability or the intended trajectory, and a need for a method and device that would minimize adverse effects on the operation or use of the host firearm.

SUMMARY OF THE PRESENT INVENTION

The present invention comprises a method of firearm blast suppression, and a device to facilitate said method, by preventing solid propellant particles from suspending, and by removing solid propellant particles from suspension, within a plurality of gases ejected from a firearm muzzle.

The method comprises a means for temporarily detaining the solid propellant particles to burn within the device while allowing gases to flow through the device with minimal turbulence and resistance. The separated solid propellant particles detained within the device burn and convert to gas, which then progress through the device. The method and the device allow a bullet to quickly move away from the propellant solids and gases, thereby minimizing the effects of a plurality of asymmetrical forces produced by the propellant solids and gases. The device additionally comprises a plurality of various features that are organized in a manner to direct the flow of gases exiting said device in a direction co-linear to the path of the bullet.

In a preferred embodiment, the device of a sound suppressor assembly facilitating the method of the present invention takes advantage of particle motion physics in order to prevent solid propellant particles in inertial motion from suspending within a propellant gas flow, each concomitantly emitted from a firearm barrel. Said device and said method also take advantage of fluid flow dynamics along with particle motion physics to separate solid propellant particles in suspension within a gas-solid flow comprising solid propellant particles and propellant gases concomitantly emitted from a firearm barrel.

Said device comprises a plurality of solid detainment pockets which allow solid particles in inertial motion to enter, but not move through. Said device also comprises a plurality of features directing said gas-solid fluid flow toward said pockets accelerating through a plurality of channels formed by features of the device. A Venturi effect caused by said accelerated flow through said channels is used to change the direction of said gas-solid flow in a path away from said pockets and to continue through the device. Some solids in said gas-solid flow will have enough inertia to escape the suspension within said gas-solid flow as said gas-solid flow changes direction, and will continue on a path toward and into said pockets. Solids are detained in said pockets as they continue to burn and convert to gases, which will exit said pocket and enter the fluid flow through the device. As such, the method and the features of the device define separate paths within the device for solid propellant particles and for the gas-solid fluid flow stream.

In a preferred embodiment, the sound suppressor assembly of the present invention comprises an open outer container, or cylinder, having a first end and a second end, wherein said outer cylinder is able to receive a monolithic baffle member. Said baffle member can optionally employ some or all of the features of the invention as necessary in order to achieve a desired effect for a specific application of the device. The present invention further comprises a base member, wherein said base is used to bind said outer cylinder and said baffle member into a coaxial assembly and thus provide a means to affix the sound suppressor assembly of the present invention to an end of a firearm.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

FIG. 14 depicts a various sectional views of a preferred embodiment of a parallel path suppressor assembly of the present invention illustrating a plurality of processes of entrapment and detainment of a plurality of freely moving solid propellant particles as described in the method of the present invention. FIG. 14A depicts a sectional view of a preferred embodiment of a parallel path suppressor assembly of the present invention illustrating an initial stage of entrapment and detainment of a plurality of freely moving solid propellant particles. FIG. 14B depicts a sectional view of a preferred embodiment of a parallel path suppressor assembly of the present invention illustrating an alternate stage of entrapment and detainment of a plurality of freely moving solid propellant particles.

FIG. 15 depicts a various sectional views of a preferred embodiment of a parallel path suppressor assembly of the present invention illustrating a plurality of processes of separating a plurality of solid propellant particles from suspension and detainment of said particles as described in the method of the present invention. FIG. 15A depicts a sectional view of a preferred embodiment of a parallel path suppressor assembly of the present invention illustrating an initial stage of separating a plurality of solid propellant particles from suspension. FIG. 15B depicts a sectional view of a preferred embodiment of a parallel path suppressor assembly of the present invention illustrating an alternate stage of separating a plurality of solid propellant particles from suspension and detainment of said particles.

FIG. 13*c* depicts an alternate cross-sectional view of a preferred embodiment of a parallel path suppressor assembly of the present invention.

FIG. 13*d* depicts another alternate cross-sectional view of a preferred embodiment of a parallel path suppressor assembly of the present invention.

FIG. 13*e* depicts another cross-sectional view of a preferred embodiment of a parallel path suppressor assembly of the present invention, FIG. 14 depicts various sectional views of a preferred embodiment of a parallel path suppressor assembly of the present invention illustrating a plurality of processes of entrapment and detainment of a plurality of freely moving solid propellant particles as described in the method of the present invention.

FIG. 14*a* depicts a sectional view of a preferred embodiment of a parallel path suppressor assembly of the present invention illustrating an initial stage of entrapment and detainment of a plurality of freely moving solid propellant particles.

FIG. 14*b* depicts a sectional view of a preferred embodiment of a parallel path suppressor assembly of the present invention illustrating an alternate stage of entrapment and detainment of a plurality of freely moving solid propellant particles.

FIG. 15 depicts various sectional views of a preferred embodiment of a parallel path suppressor assembly of the present invention illustrating a plurality of processes of separating a plurality of solid propellant particles from suspension and detainment of said particles as described in the method of the present invention.

FIG. 15*a* depicts a sectional view of a preferred embodiment of a parallel path suppressor assembly of the present invention illustrating an initial stage of separating a plurality of solid propellant particles from suspension.

FIG. 15*b* depicts a sectional view of a preferred embodiment of a parallel path suppressor assembly of the present invention illustrating an alternate stage of separating a plurality of solid propellant particles from suspension and detainment of said particles.

DETAILED DESCRIPTION OF A PREFERRED EMBODIMENT

Figure 1:
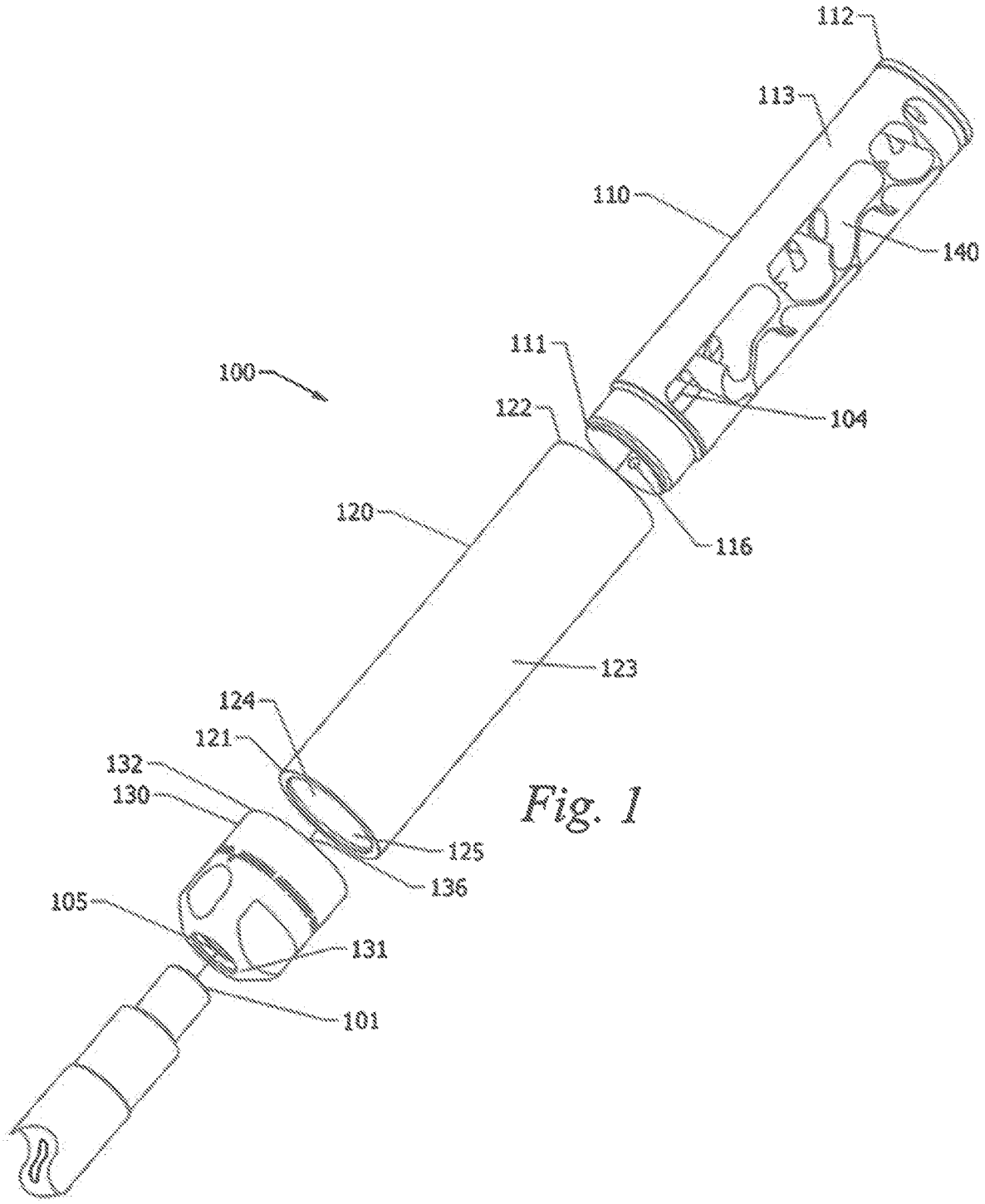
FIG. 1 depicts an exploded perspective view of a preferred embodiment of a parallel path firearm sound suppressor assembly of the present invention.

Referring to the drawings, an objective of the method of the present invention is to enable a firearm sound suppressor, or a device to reduce sound and flash emanating from a firearm muzzle, that functions by preventing a plurality of solid propellant particles that are ejected from the firearm muzzle from suspending in a gas-solid flow, and removing said solid propellant particles from the gas-solid suspension that is ejected from the firearm muzzle.

The method of the present invention provides for a means in which said solid propellant particles, that are in inertial motion as they are ejected from the firearm muzzle, are detained and substantially isolated from a flow of fluids through said device until said solid propellant particles burn and convert to a plurality of gases. Additionally, the method of the present invention provides for a means in which said solid propellant particles that are suspended in a heterogeneous gas-solid fluid as they are ejected from the firearm muzzle are separated from suspension using a linear inertial separation method and are detained and substantially isolated from the flow of fluids through the device until said solid propellant particles burn and convert to gases.

The method of the present invention recognizes that, simply stated, sound and flash occur as a combined mass ejection of said solid propellant particles in inertial motion, gases, and a gas-particle suspension escape from a firearm barrel and mix with the surrounding air. The escaping of said solid propellant particles in inertial motion, gases, and a gas-particle suspension typically begins as the bullet exits the barrel.

The method of the present invention further recognizes that solid propellant particles that are leaving the firearm barrel may not be instantly consumed and converted to a plurality of gases. As such, solid propellant particles that are not completely consumed and are not part of the gas-solid suspension are hereinafter referred to as "solids", "propellant particles," or "particles."

The method of the present invention further recognizes that propellant gases may mix with insitu gases within the device, such as air, vaporized water, and residual propellant gases. As such, any combination of gases that are flowing into, within, or exiting the device are hereinafter referred to as "gas", "propellant gases," or "gases."

The method of the present invention further recognizes that a heterogeneous mixture of particles and gases exiting the barrel can be characterized as a gas-solid flow. A gas-solid flow is characterized by the flow of gases with suspended solids. This type of flow is fundamental to many industrial processes, such as pneumatic transport, particulate pollution control, combustion of pulverized coal, drying of food products, sand blasting, plasma-arc coating and fluidized bed mixing. As such, said mixture of propellant particles and propellant gases flowing through the device at any moment are hereinafter referred to as "gas-solid flow," or "gas-particle flow," or simply, "the flow."

The method of the present invention further recognizes that particles can be removed from a gas-solid flow by the process of inertial separation. This process requires influencing or allowing the gases to change flow direction while providing a path for particles to leave the gas-solid flow while minimizing turbulent flow. Common inertial separation methods are cyclonic and linear. Cyclonic inertial separators are widely used in process flow applications and modern cyclonic vacuum cleaners. Linear inertial separators are widely used in aviation turbine engine applications where the separated solids are influenced to leave the gas-solid flow as the gases are influenced to change direction, and the particles continue in the direction prior of the gas-solid flow prior to the change of direction. As such, the method of the present invention employs a linear separation method wherein the separated solids are influenced to an area or volume away from the flow and assumes that the particles will remain detained until completely converted to gas which rejoins the gas-solid flow.

The method of the present invention recognizes that particles in motion will remain in motion until otherwise influenced. The method also recognizes that propellant particles commonly accelerate past the bullet as the bullet exits the firearm muzzle. Moreover, the method of the present invention recognizes that gases will move passively from an area of higher pressure to an area of lower pressure.

Additionally, the method of the present invention recognizes that a mass flow rate of a gaseous flow through an orifice is primarily dependent on the cross-sectional area of the orifice and the upstream pressure. Given two orifices with the same upstream pressure, the orifice with a substantially larger cross-sectional area will have a substantially higher mass flow rate.

The method comprises a plurality of distinctly separate operations on separate but concomitant events, a gas-solid flow and particles moving substantially independent of the gas-solid flow, wherein together, all of said operations comprise a firearm muzzle blast: (1) the method of the present invention comprises allowing for a plurality of particles to move substantially independent of the gas-solid flow in order to enter areas substantially separate from the path of the gas-solid flow; (2) the method comprises allowing the gas-solid flow to move from areas of substantially higher pressure towards areas of substantially lower pressure, thereby causing a change in the direction of the gas-solid flow with substantially minimal turbulent flow; and, (3) the method comprises allowing for a plurality of particles to leave the gas-solid flow as the flow changes direction in order to move to areas substantially separate from the path of the gas-solid flow.

Figures 13, 13A, 13B, 13C, 13D, 13E:
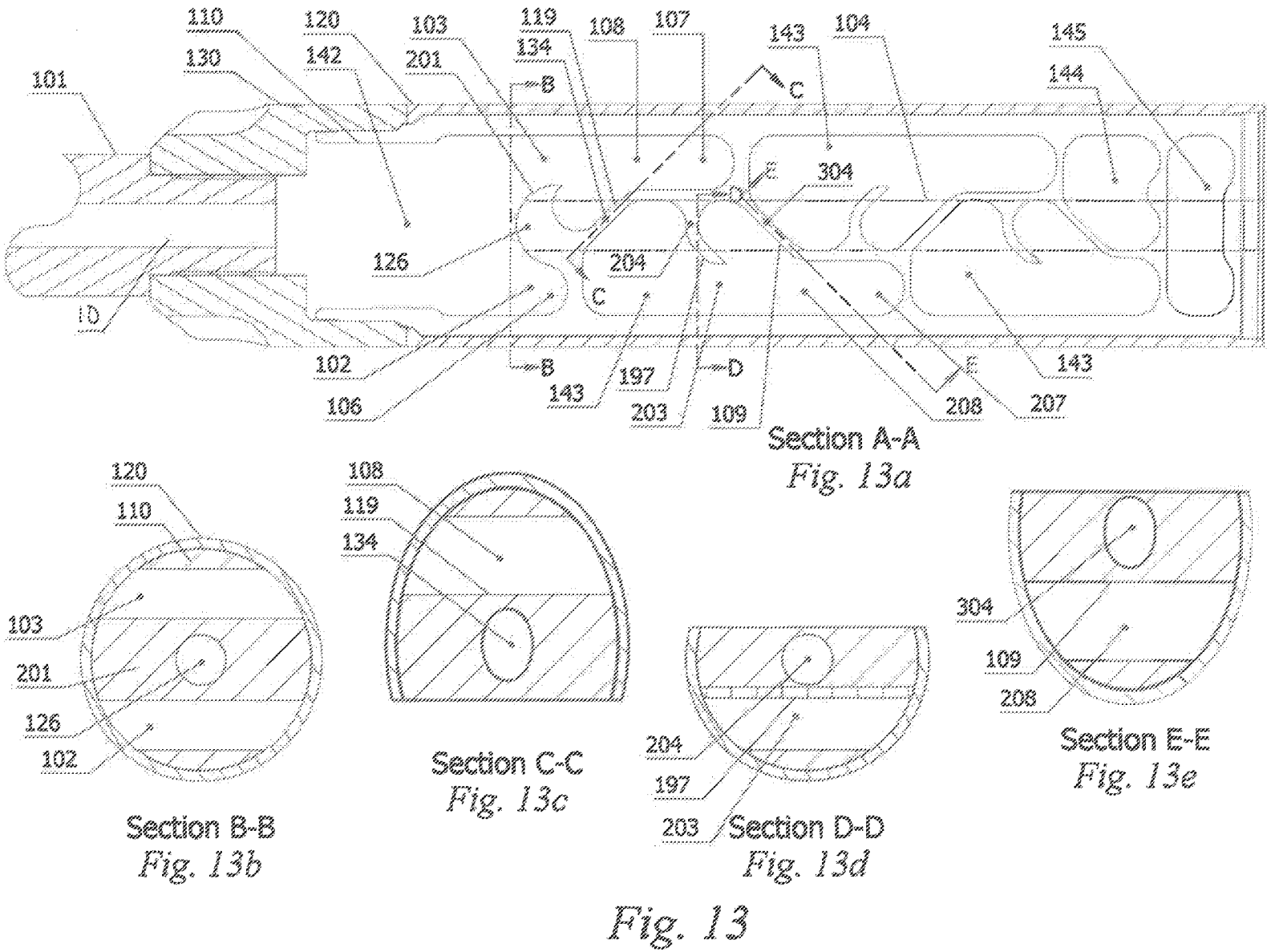
FIG. 13 depicts various sectional views of a preferred embodiment of a parallel path suppressor assembly of the present invention identifying a plurality of physical features of said assembly as said features pertain to the method of the present invention.
FIG. 13A depicts a sectional view of a preferred embodiment of a parallel path suppressor assembly of the present invention identifying a plurality of physical features of said assembly as said features pertain to the method of the present invention.
FIG. 13B depicts a cross-sectional view of a preferred embodiment of a parallel path suppressor assembly of the present invention.
FIG. 13C depicts an alternate cross-sectional view of a preferred embodiment of a parallel path suppressor assembly of the present invention.
FIG. 13D depicts another alternate cross-sectional view of a preferred embodiment of a parallel path suppressor assembly of the present invention.
FIG. 13E depicts another cross-sectional view of a preferred embodiment of a parallel path suppressor assembly of the present invention.

Referring to the figures, FIG. 13 depicts a plurality of sectioned views of the assembled device 100 and barrel 10 of firearm 101. The assembled device 100 comprises a plurality of various features that are used to facilitate the method of the present invention.

FIG. 13*a* depicts a sectional view of said parallel path suppressor assembly 100 comprising said features that are used to facilitate the method of the current invention. Said assembly 100 comprises a plurality of solids detainment pockets 106, 107, and 207. Said pockets 106, 107, and 207 accept a plurality of propellant particles in inertial motion and detain them in a substantially isolated manner from the flow of fluids through device 100. Additionally, assembly 100 comprises a blast baffle 201 and a vane 197. Said baffle 201 and said vane 197 influence fluid flow towards a plurality of channels 103 and 203, and subsequently towards said pockets 107 and 207, Said blast baffle 201 and said vane 197 also partially define said channels through which fluid flow accelerates.

Moreover, parallel path suppressor assembly 100 comprises a bullet pathway 104. Said bullet pathway 104 is collinear to said host firearm barrel and extends throughout the entire device. As such, bullet pathway 104 defines blast baffle bullet pathway hole 126, vane bullet pathway holes 204, a plurality of elliptical baffle holes 134 and 304, and any other bullet pathway hole that extends throughout other features of said device, such as, a transition chamber and a straightening chamber.

Parallel path suppressor assembly 100 further comprises a blast chamber 142, a plurality of linear inertial separation chambers 140, a transition chamber 144, and a gas straightening chamber 145. Additionally, said assembly 100 further comprises a plurality of baffles 119 and 109. Said baffles 119 and 109 direct a plurality of gases entering into the linear inertial separation chambers 140 and towards channels 203.

FIG. 13*b* depicts a cross-sectional view of parallel path suppressor assembly 100 of the present invention, comprising a window 102 and a channel 103 that are defined by a shell 120, a core 110, and a blast baffle 201. Window 102 provides access to a first proximal solids detainment pocket 106. Channel 103 provides access to a first baffle hole 134 and a second proximal solids detainment pocket 107. It is to be noted that cross-sectional areas of window 102 and channel 103 are each substantially larger than the cross-sectional area of proximal bullet pathway hole 126.

Still referring to FIG. 13, FIG. 13*c* depicts an alternate cross-sectional view of parallel path suppressor assembly 100, illustrating a window 108 that is defined by shell 120, core 110, and vane 119. An elliptical baffle hole 134 is formed by the bullet pathway 104 through the first baffle 119. It is to be noted that the cross-sectional area of the elliptical hole 134 is substantially larger than the cross-sectional area of the blast baffle bullet pathway hole 126. Window 108 provides access to the second proximal solids detainment pocket 107.

FIG. 13*d* depicts an alternate cross-sectional view of parallel path suppressor assembly 100 comprising channel 203 that is defined by shell 120, core 110, and diverter vane 197. Channel 203 provides access to a first distal baffle 109 and the first distal solids detainment pocket 207. It is to be noted that the cross-sectional area of channel 203 is substantially larger than the cross-sectional area of the vane bullet pathway hole 204.

FIG. 13*e* depicts an alternate cross-sectional view of parallel path suppressor assembly 100 comprising a window 208 that is defined by shell 120, core 110, and baffle 109. The elliptical baffle hole 304 is formed by the bullet pathway 104 through the first distal baffle 109. It is to be noted that the cross-sectional area of the elliptical hole 134 is substantially larger than the cross-sectional area of the first diverter vane bullet pathway hole 204. Window 208 provides access to the first distal solids detainment pocket 207.

FIG. 14*a* depicts a sectional view of parallel path suppressor assembly 100 of the present invention illustrating the method of entrapment of a plurality of particles 300 exiting the firearm barrel 10 that are substantially independent of the gas-solid flow. Particles 300 exit the barrel behind the bullet 305 as the bullet 305 leaves the barrel 10 and approaches the bullet pathway hole 126 in the blast baffle 201. The particles 300, being substantially lighter than the bullet 305 but acted on by the same forces, can reach a velocity that is substantially greater than the velocity of the bullet 305 with a similar trajectory, and can pass the bullet 305 as said bullet 305 advances. As the particles 300 will initially travel in a substantially straight line, few of the particles will have access to the blast baffle bullet pathway hole 126 as the bullet 305 blocks access to the bullet pathway hole 126 while the bullet 305 approaches and moves through the blast baffle 201. Particles 300 passing through window 102 and channel 103 can move towards solids detainment pockets 106 and 107. Particles 300 impacting an inner surface of the shell 120, the baffle core 110, and the blast baffle 201 are deflected towards pockets 106 or 107, or towards other features of the device. A substantial quantity of the particles 300 will enter the detainment pockets 106 and 107 where they can burn and convert to gas.

FIG. 14*b* depicts a sectional view of the parallel path suppressor assembly 100 of the present invention illustrating the bullet 305 advancing past the blast baffle 201 and past said separation chamber 143. Particles 300 are able to enter and advance through the bullet pathway. These particles 300 will either impact a base of the bullet 305, divert from the bullet pathway and impact other features or get detained within one of the pockets, or burn and convert to gas, which can then enter the gas-solid flow. Referring back to FIG. 13*b*, the bullet pathway hole 126 represents a substantially small fraction of a number of trajectories that are available for the particles to move into the device 100.

FIGS. 15*a* and 15*b* depict a sectional view of the device 100 of the present invention illustrating the method by which some of the gas-solid flow 400 is influenced to change direction, as depicted at 402 and 406, within the device 100 using said features that are defined by the device 100. In doing so, the inertia of some of the suspended particles within the gas-solid flow will overcome the centripetal forces which would keep the particles suspended, and those particles 403 would leave the suspension.

It is to be observed that this description herein assumes a simplified model, wherein a gas-solid flow 400 is substantially uniform in density and velocity as it enters the device. This description herein also assumes upstream pressures exceed downstream pressures unless specified, and does not make a distinction between subsonic and supersonic flow characteristics unless specified. While choked gas flow conditions should be considered in device designs, it is not addressed within the description herein.

Referring back to the figures, in the preferred embodiment, upon entering parallel path suppressor assembly 100, the uniform gas-solid flow 400 stream presents to multiple paths through which it can continue, including, but not limited to, the bullet pathway hole 126, window 102, and channel 103. Assuming the velocities through each remain substantially the same, a substantially greater mass will move through each of said window 102 and said channel 103 than will through bullet pathway hole 126. Referencing FIG. 13*a*, gases entering first proximal solids detainment pocket 106 will soon fill the volume, and pressures on both sides of window 102 will be at equilibrium, and the forward movement of the gas-solid flow will not continue through window 102. As such, in a substantially steady state of flow, all of the gas-solid flow 400 will continue in part as gas-solid flow 402 through channel 103 and in part as solid gas flow 401 through bullet pathway hole 126.

The gas-solid flow 402 will accelerate through channel 103 and expand towards window 108 and first baffle hole 134, Gases entering second proximal solids detainment pocket 107 will soon fill the volume, and pressures on both sides of window 108 will be at equilibrium, and the forward movement of the gas-solid flow will not continue through window 108. As such, in a substantially steady state of flow, all of the gas-solid flow 402 will continue through channel 103 towards first baffle hole 134.

Gas-solid flows 401 and 402 will converge as they move toward the first baffle hole 134. The combined gas-solid flow 404 will expand as it moves through the first baffle hole 134 and enters the subsequent chamber 143.

Referencing FIGS. 15*b* and 13*d*, the combined gas-solid flow 404 will present to multiple paths through which it can continue, including, but not limited to, bullet pathway hole 204 through the diverter vane 197, and channel 203. Assuming the velocities through each remain substantially the same, a substantially greater mass will move through channel 203 than will through bullet pathway hole 204.

Referring to FIGS. 15*b* and 13*e*, the gas-solid flow 406 will accelerate through channel 203 and expand towards window 208 and baffle hole 304. Gases entering solids detainment pocket 207 will soon fill the volume, and pressures on both sides of window 208 will be at equilibrium, and the forward movement of the gas-solid flow will not continue through window 208. As such, in a substantially steady state of flow, all of the gas-solid flow 404 will continue through channel 203 and bullet pathway hole 204 towards baffle hole 304.

Gas-solid flows 405 and 406 will converge as they move toward the first baffle hole 304. The combined gas-solid flow 407 will expand as it moves through the first baffle hole 304 and enters the subsequent chamber 143. As such, the method of the present invention allows for the control of flow direction through the device.

Referring back to FIGS. 15*a* and 15*b*, and FIGS. 13*b* and 13*d*, the gas-solid flows 402 and 406 accelerate to move through channels 103 and 203 respectively, changing direction dramatically and rapidly to continue through the device 100. Some particles suspended within the gas-solid flows 402 and 406 will have enough inertia to overcome the centripetal forces keeping them suspended in the gas-solid flows. The device 100 facilitating the method positions solids detainment pockets, such as pockets 107 and 207, in the projected paths of these separated particles 403, where said separated particles 403 can enter the detainment pockets to burn and convert to gas, which can then enter the gas-solid flow.

Another aspect of the device 100 of the invention is the ability to consolidate the separate flow streams and eject them from the device in a direction substantially co-linear to the bullet pathway and with minimal induced turbulence within said device 100. As such, referring to FIG. 16, gas-solid flow streams 501 and 502 leave chamber 140 and combine to flow substantially through the bullet pathway into and through transitioning chamber 144. Gases entering transitioning chamber 144 will soon fill the volume, and the pressure within chamber 144 will exceed that of the straightening chamber 145. The combined flows of 501 and 502 will seek to flow to an area of lowest pressure in straightening chamber 145.

Portions of the combined flow streams 501 and 502 with enough inertia 504 to leave the combined flow will concomitantly enter transitioning chamber 144 as it displaces gases 505 with less inertia from within transitioning chamber 144. These displaced gases 505 and the remainder of the combined flow streams of 501 and 502 will move together 506 toward the area of lower pressure and into straightening chamber 145.

Figure 16:
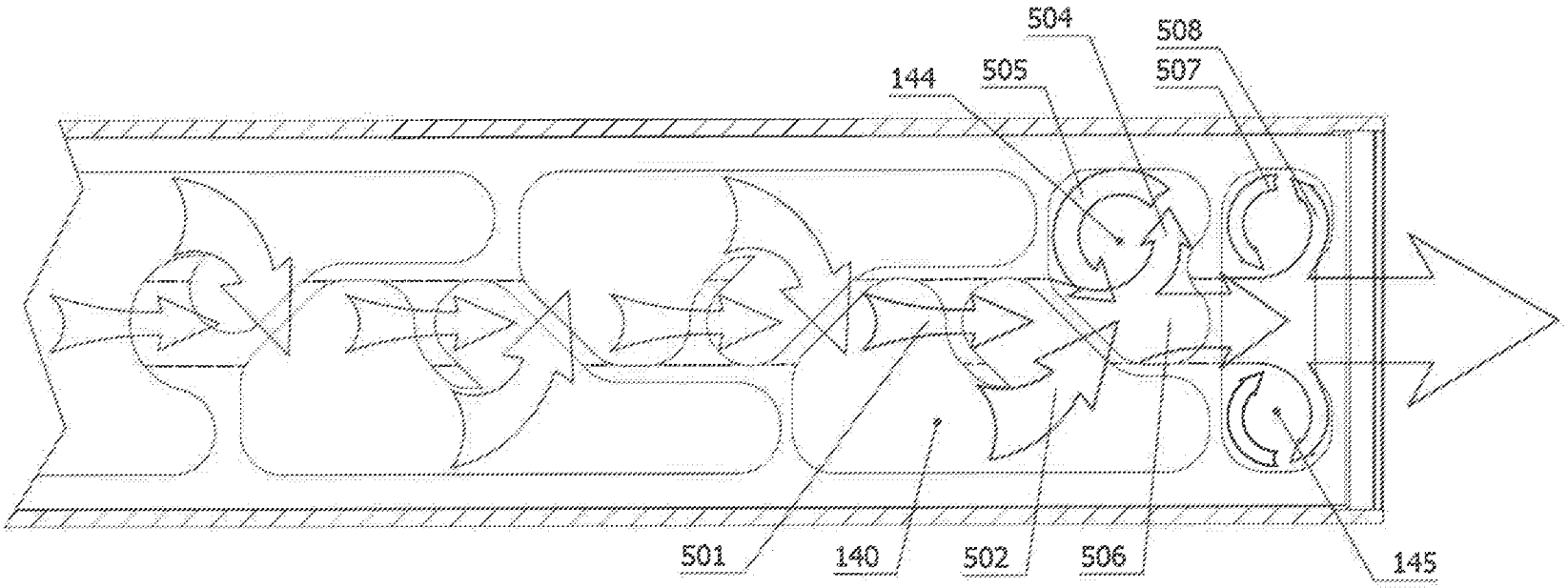
FIG. 16 depicts a sectional view of a preferred embodiment of a parallel path suppressor assembly of the present invention identifying a plurality of physical features of said assembly as said features pertain to the recombination of gases and directing the flow of gases exiting from the device.

Still referring to FIG. 16, as the gas-solid flow 506 moves through straightening chamber 145, the chamber 145 soon fills and the gas-solid flow 506 will tend to move toward the substantially lower atmospheric pressure outside of device 100. Some substantially higher energy gases 508 will displace lower energy gases 507, which will combine with the remainder of the gas-solid flow 506 to exit the device 100.

As such, firearm sound and flash reduction can be accomplished by using linear inertial separation to remove propellant particles from the flow stream with a minimum amount of turbulence and back pressure. The propellant does continue to burn within the device 100 and the gases do flow through and exit the device 100, but they do so at slightly different times such that backpressure is minimized. The bullet is effectively isolated from the blast event, thereby minimizing the blast event affecting bullet stability, and the direction of exiting gases is managed in order to avoid unwanted muzzle movement.

Referring to the figures, a firearm sound suppressor assembly 100 of the present invention provides a means to optimize firearm suppressor efficiency with regards to maximizing sound attenuation, preserving the stability and ballistic integrity of a bullet fired through said sound suppressor assembly, minimizing the physical size and weight of said assembly, and the ability to completely disassemble said assembly by a user who is generally skilled and equipped to maintain a firearm.

The parallel path suppressor assembly 100 of the present invention, or the device, generally comprises a container having a proximal end, a distal end, an outer surface, and a plurality of inner surfaces defining an inner chamber, wherein said proximal end and said distal end each comprise an opening, and at least one feature, or a pocket having a proximal end, a distal end, and an opening within the proximal end that can accept a plurality of propellant particles in inertial motion and detain said particles in a substantially isolated manner from the flow of fluids throughout said device. Additionally, the assembly of the present invention comprises a plurality of features that are used to influence said particles toward said pockets.

The parallel path suppressor assembly, or apparatus, 100 of the present invention further comprises a plurality of features that can influence fluid flow toward said pockets, and also comprises a plurality of features that can influence a change in said fluid flow away from said pockets. One such feature is a vane. Said vane is employed with other features of the device in order to create a Venturi channel, hereinafter referred to as a channel, through which fluids will accelerate. The proximal surface of said vane influences said fluid flow towards said channel and through said channel where said fluid flow accelerates and changes direction towards said pockets. As such, a Venturi effect is thus created within and immediately downstream of said channel which influences said fluid flow to change to a direction away from said pockets.

As a result, said features of the device of the present invention are arranged, with respect to each other, the firearm, said solid propellant particles in inertial motion, and the flow of the fluids through the device, with the intention of being able to affect the method of the invention.

In the preferred embodiment, sound suppressor assembly 100 of the present invention can be manufactured from a variety of substantially high strength metals, such as, for example, titanium and Inconel, substantially high tensile strength aluminum alloys and stainless steel, or even composite materials and plastics, or any other similar material having like characteristics. Further, the present invention can be manufactured in a variety of different sizes, wherein the overall size of the sound suppressor assembly 100 and the relative sizes of the separate containers are dependent upon a user's specific application, firearm device, and desired physical and sound characteristics.

Referring back to FIG. 1, in a preferred embodiment, FIG. 1 depicts an exploded perspective view of sound suppressor assembly 100 generally comprising an outer cylinder, or sleeve, 120, a monolithic baffle 110, and a base member 130. Outer cylinder 120 comprises an outer diameter 123 and an inner diameter 124, thereby defining an inner pathway, or chamber 125, for receiving monolithic baffle 110. Additionally, outer cylinder 120 comprises a proximal end 121 and a distal end 122, wherein proximal end 121 is adjacently aligned to, and thus, closed by base member 130. Thus, proximal end 121 of outer cylinder 120 is impinged between monolithic baffle 110 and base member 130, thereby allowing baffle member 110 to be able to expand longitudinally within outer sleeve 120.

Monolithic baffle member 110 comprises a substantially cylindrical body member, having an outer diameter 113, a proximal end 111 and a distal end 112, wherein proximal end 111 is threadably affixed to, and thus, closed by base member 130. Outer diameter 113 of monolithic baffle 110 is substantially less than inner diameter 124 of outer cylinder 120, thereby allowing baffle 110 to be received within inner chamber 125 of outer cylinder 120. Body member of monolithic baffle 110 comprises a plurality of interior openings, or chambers 140, in order to produce a specific effect, such as, for example, solid and fluid separation. Additionally, monolithic baffle 110 further comprises a bullet pathway hole 104, wherein said bullet pathway hole 104 breaches the entirety of baffle member 110 along a longitudinal axis, from proximal end to distal end.

In a preferred embodiment, base member 130 comprises a substantially cylindrical configuration, having a proximal end 131 and a distal end 132, wherein distal end 132 is threadably affixed to monolithic baffle 110. Base member 130 further comprises a through-hole 105 that is coaxial to bullet pathway hole 104 of baffle 110, wherein through-hole 105 provides a means to attach sound suppressor assembly 100 directly to a firearm muzzle 101 or to accommodate sound suppressor assembly 100 to selectively attach to a firearm muzzle 101. As such, an end of sound suppressor assembly 100 defined by base member 130 is hereinafter referred to as the proximal end of the device 100 and the opposite end is hereinafter referred to as the distal end of the device 100.

Figure 2:
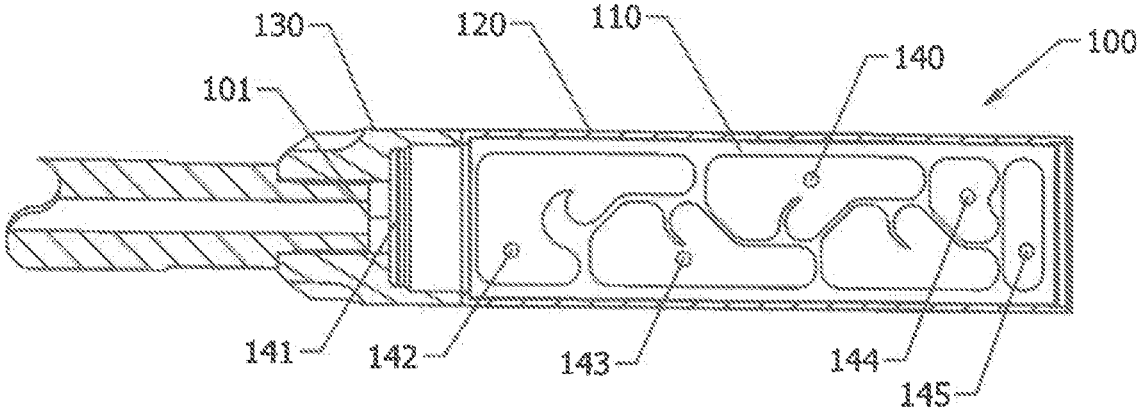
FIG. 2 depicts a sectional view of a preferred embodiment of a parallel path firearm sound suppressor assembly of the present invention.

FIG. 2 depicts a longitudinal sectional view of sound suppressor assembly 100 in an assembled configuration, wherein base 130 is used to attachably connect outer cylinder 120 and baffle member 110 to a firearm muzzle 101 by way of a threaded connection. By way of illustration, but not limitation, base 130 can be used to attachably connect to firearm muzzle 101, or any other similar device that can be attached to an end of a firearm muzzle, by way of a threaded connection, or any other similar attachment means. Monolithic baffle 110 is received within outer cylinder 120 of sound suppressor assembly 100 and attachably connected to base member 130, wherein baffle 110 further comprises a plurality of chambers 140 that are substantially independent of each other, except for any openings that are created by bullet pathway hole 104.

As depicted in FIG. 2, baffle member 110 is received within inner chamber 125 of outer cylinder 120, wherein outer diameter 113 of baffle member 110 is slightly less than inner diameter 124 of outer cylinder 120. Further, body member of monolithic baffle 110 comprises chambers 140 in order to produce a specific effect, such as, for example, solid and fluid separation. Thus, a proximal chamber 141 is formed by the combination of a threaded cavity 136 on the distal end 132 of base member 130 and a cavity 116 within the mating threaded feature on the proximal end 111 of baffle member 110.

Additionally, a first chamber 142 of baffle 110, a plurality of subsequent chambers 143, a transition chamber 144 and a gas alignment chamber 145 are all formed as a result of baffle member 110 being received within outer cylinder 120, whereby said chambers 140 have a variety of different functions. As a result, baffle member 110 is employed to cause separation of solid propellant from fluids in order for said solids to be able to be caught and thus slowly burned within said sound suppressor assembly 100.

Figure 3C:
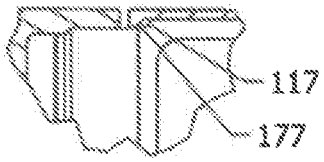
FIG. 3*c* depicts an enhanced view of an alternate embodiment of a mating relationship of an outer cylinder, a baffle member, and a base member of a parallel path firearm sound suppressor assembly.
Figure 3A:
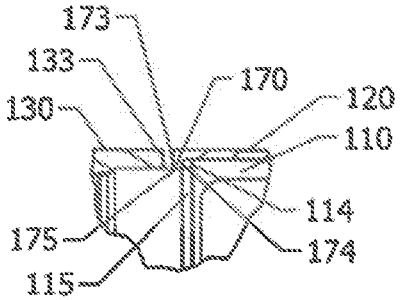
FIG. 3*a* depicts an enhanced view of a preferred embodiment of a mating relationship of an outer cylinder, a baffle member, and a base member of a parallel path firearm sound suppressor assembly.
Figure 3B:
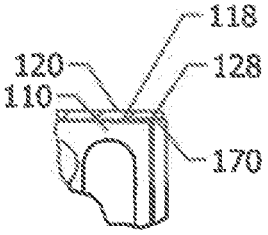
FIG. 3*b* depicts an enhanced view of a preferred embodiment of an outer cylinder and a baffle member of a parallel path firearm sound suppressor assembly of the present invention in an assembled configuration.
Figure 3:
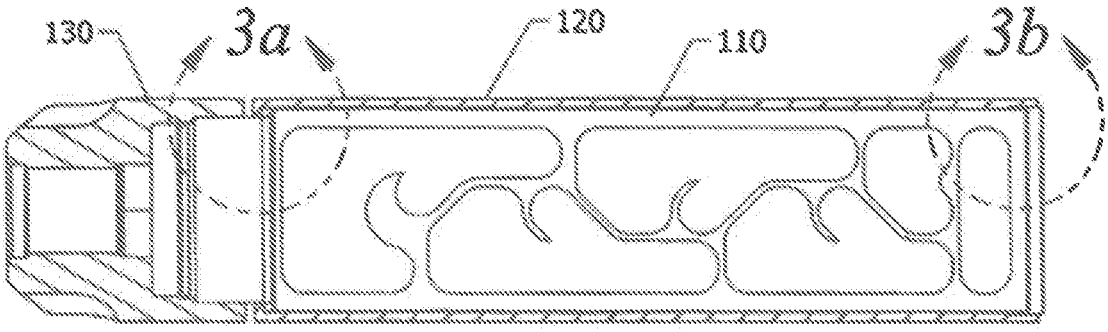
FIG. 3 depicts a sectional view of a preferred embodiment of a parallel path firearm sound suppressor assembly of the present invention in a loosely assembled configuration to illustrate points of contact between the component parts.

FIG. 3 depicts a longitudinal sectional view of sound suppressor assembly 100 in a loosely assembled configuration, generally comprising outer cylinder 120, monolithic baffle 110, and base member 130. FIGS. 3*a*, 3*b*, and 3*c* depict enhanced views from FIG. 3, further illustrating the relationships of the component parts of sound suppressor assembly 100 when in an assembled configuration.

In a preferred embodiment, proximal end 121 of outer sleeve 120 comprises a flange member 170 extending in a radially inward direction to the extent that an inner cylindrical surface 175 of flange 170 achieves a substantially contact fit with a radial shoulder 115 of baffle member 110. As sound suppressor assembly 100 is assembled, a planar bearing face 133 of base 130 makes substantially coplanar contact with a planar bearing face 173 of flange 170 of outer sleeve 120. As base member 130 approaches baffle member 110, a planar distal inner face 174 of flange 170 makes coplanar contact with a planar proximal bearing face 114 of baffle member 110. As a result, said component parts of sound suppressor assembly 100 become axially aligned as sleeve flange member 170 is impinged between base 130 and baffle member 110, thereby allowing said components to move longitudinally independent of each other due to thermal expansion or a plurality of different forces experienced during use.

In an alternative embodiment, as illustrated in FIG. 3*c*, the planar bearing face at distal inner face 174 of flange 170 and proximal bearing face 114 of baffle 110 and a contact fit between said inner cylindrical surface 175 of the flange 170 and said radial shoulder 115 are replaced with a substantially concave conical bearing surface 177 on a distal inner surface of said flange 170 and a mating convex conical bearing surface 117 of said baffle 110. Further, concomitant to the positioning of proximal end 121 of outer sleeve 120 to baffle member 110, an internal cylindrical surface 128 of distal end 122 of outer sleeve 120 can mate with an external cylindrical shoulder 170 concentric to said cylindrical surface 128 and near distal end 112 of baffle member 110.

Figure 4:
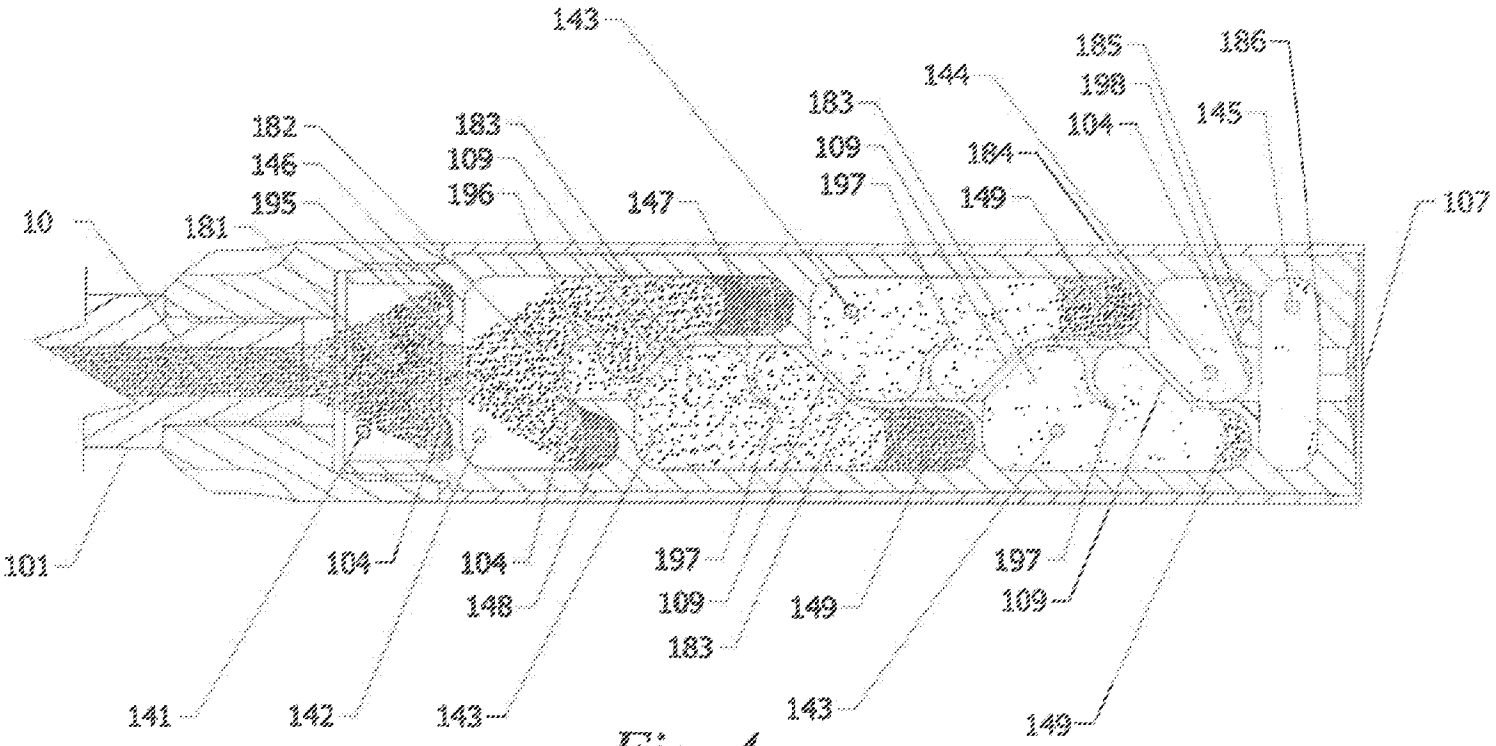
FIG. 4 depicts a sectional view of a preferred embodiment of a parallel path firearm sound suppressor assembly of the present invention illustrating the treatment of solids in a method of parallel path firearm sound suppression.

FIG. 4 depicts a longitudinal sectional view of an embodiment of sound suppressor assembly 100 in an assembled configuration generally comprising outer container 120, baffle member 110, and base member 130. Operationally, sound suppressor assembly 100 is able to remove a plurality of suspended solids from a propellant gaseous flow stream to a variety of different areas within the chambers that are relatively isolated from the flow stream. The propellant gas and solids enter sound suppressor assembly 100 from within a barrel 102 of a firearm 101 into the proximal chamber 141. As propellant burns and gases expand, increasing pressure forces the fluids to flow towards areas of substantially lower pressure. The solid propellant particles 181 move in a substantially forward direction within chamber 141 to continue through the bullet pathway hole 104, remain substantially suspended within the gas and are ejected through the bullet pathway hole 104 with the exiting solid-gas suspension, or adhere to the inside surfaces 146 of chamber 141 where they continue to burn or remain as residue. A diverter member 195 partially isolates the deposited solids from the gas flow and prevents deposited solids from obscuring the bullet pathway hole 104.

Remaining mobile solids and gases 182 continue into first baffle chamber 142 and move either substantially forward through bullet pathway hole 104 or are diverted by a diverter member 196 towards a plurality of areas 147, 148 where said solids and gases 182 are then partially isolated from the gaseous flow and wherein some of the solids are deposited where they continue to burn or remain as residue.

Remaining mobile solids and gases 183 can enter subsequent chamber 143 via a plurality of holes 109 created by the bullet pathway hole 104 intersecting a canted portion of the chamber walls. Said mobile solids and gases 183 then move in a substantially transverse direction to a longitudinal axis of sound suppressor assembly 100 until diverted by the walls of the chamber and a diverter vane 197 towards an area 149 where solids and gases 183 are partially isolated from the gaseous flow and wherein some of the solids are deposited where they continue to burn or remain as residue. This process is repeated within each of the subsequent chambers 143, It is to be observed that the number of subsequent chambers required within sound suppressor assembly 100 is dependent upon a desired and specific application of sound suppressor assembly 100.

Still referring to FIG. 4, sound suppressor assembly 100 of the present invention can employ a variety of other features in order to manage the nature of the gaseous flow as it exits the device. Any remaining mobile solids and gas 184 can enter transitional chamber 144 via a hole 109 created by the bullet pathway hole 104 intersecting a canted portion of the chamber wall and move in a substantially transverse direction to the longitudinal axis of sound suppressor assembly 100 until encountering the inside surfaces of the chamber 144. Some solids are deposited 185 within chamber 144, and the gaseous flow is redirected into the gas ejection alignment chamber 145 through bullet pathway hole 104 in a direction substantially aligned with the longitudinal axis of the present invention. A diverter member 198 partially isolates the deposited solids from the gas flow and prevents deposited solids 185 from obscuring bullet pathway hole 104.

Remaining mobile solids and gas can enter gas ejection alignment chamber 145 via bullet pathway hole 104 and move in a substantially aligned direction with the longitudinal axis of sound suppressor assembly 100 until encountering the inside surfaces of chamber 145 or ejecting through the distal end 107 of sound suppressor assembly 100 through bullet pathway hole 104 in a direction substantially aligned with the longitudinal axis of the present invention. As a result, some solids are deposited 186 within chamber 145 where they continue to burn or remain as residue.

In an alternate embodiment, a planar structure aligned with the longitudinal axis of sound suppressor assembly 100 divides the volumes defined by the baffle 110 geometry, increases surface area upon which solids can be deposited, improves isolation of deposited solids, provides rigidity to the structure, provides conductive material through which heat is transferred for dissipation, and provides structure upon which features can be included that would not be otherwise practical.

Figure 5A:
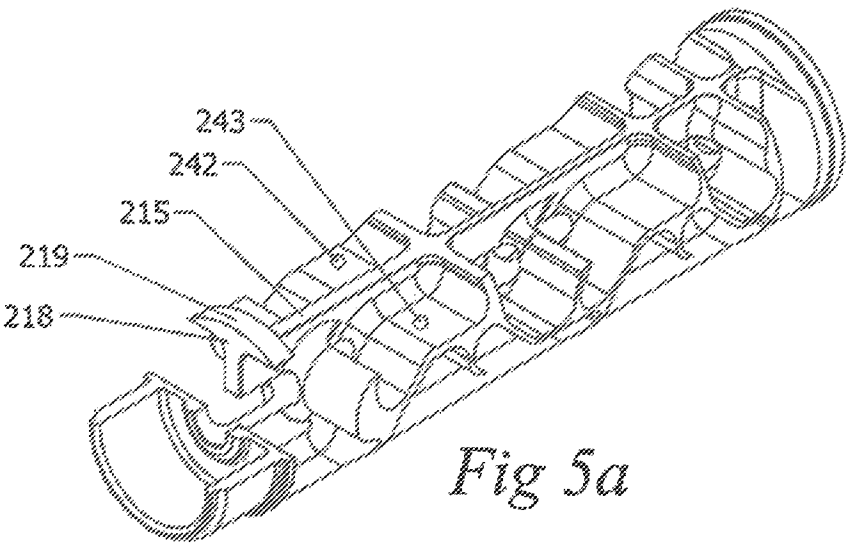
FIG. 5*a* depicts a perspective view of an alternate embodiment of a baffle of a parallel path firearm sound suppressor assembly of the present invention.
Figure 5:
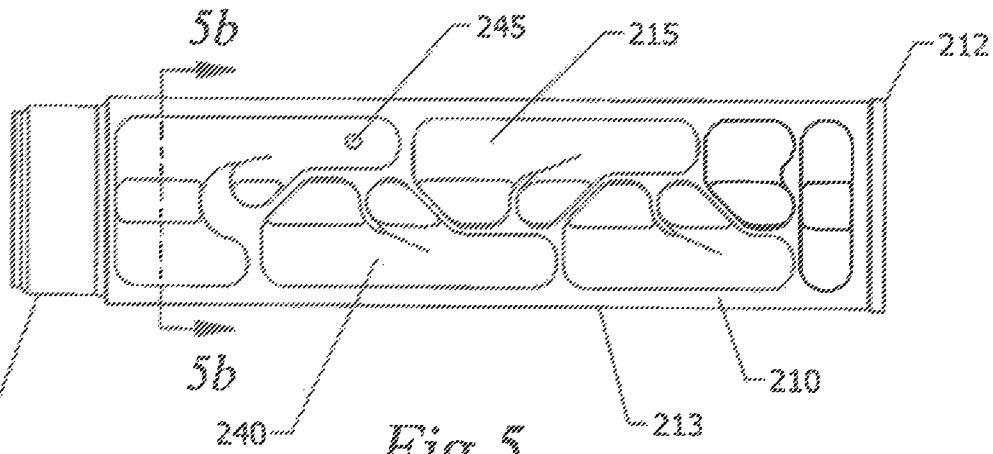
FIG. 5 depicts a side view of an alternate embodiment of a parallel path firearm sound suppressor assembly of the present invention.
Figure 5B:
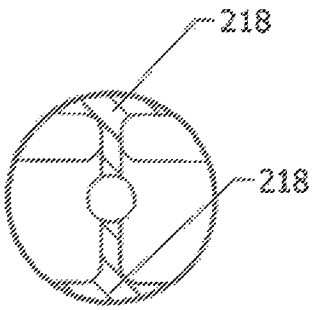
FIG. 5*b* depicts an enhanced view of an alternate embodiment of a parallel path firearm sound suppressor assembly of the present invention.

FIG. 5 depicts a side view of an alternate embodiment of sound suppressor assembly 100 comprising an alternate baffle member 210, wherein alternate baffle member 210 comprises a longitudinal divider 215. FIGS. 5*a* and 5*b* depict a perspective view nd a cross-sectional view, respectively, of alternate baffle member 210. Alternate baffle member 210 comprises a substantially cylindrical body member, having an outer diameter 213, a proximal end 211, and a distal end 212. Outer diameter 213 of alternate baffle member 210 is slightly less than inner diameter 124 of outer cylinder 120. Additionally, body member of alternate baffle member 210 comprises a plurality of openings, or chambers 240, for use in producing a specific effect, such as, for example, solid and fluid separation.

Further, as illustrated in FIGS. 5*a* and 5*b*, in an alternate embodiment, alternate baffle member 210 comprises a plurality of—typically two—"T-beam" structures 218 that are formed by an intersection of longitudinal divider 215 and a substantially semi-circular wall section 219 of said baffle 210. As a result, longitudinal divider 215 bifurcates chamber 142, thereby allowing chamber 142 to function as two separate chambers 242 and 243, wherein said chambers 242 and 243 can comprise either similar or independent functions. The consequences of bifurcation by longitudinal divider 215 can also apply to the subsequent chambers 143, transition chamber 144 and gas ejection alignment chamber 145.

Figure 6:
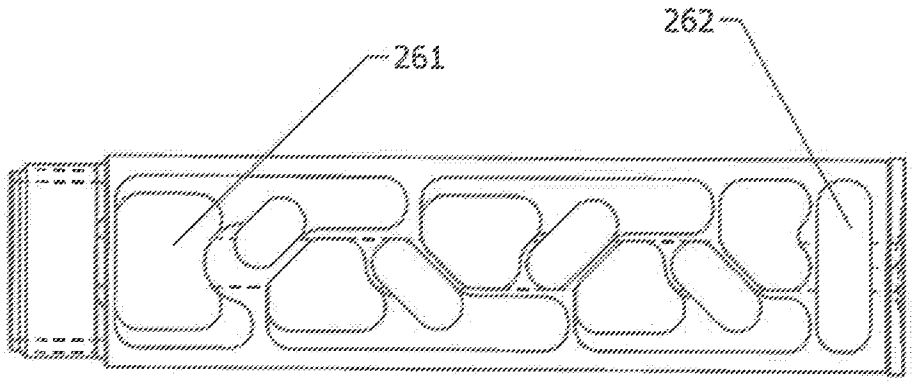
FIG. 6 depicts a side view of an alternate embodiment of a baffle of a parallel path firearm sound suppressor assembly of the present invention.

FIG. 6 depicts a side view of an alternate embodiment of sound suppressor assembly 100 of the present invention, wherein longitudinal divider 215 can be modified into a variety of different configurations. As such, a variety of different features and specifications of sound suppressor assembly 100 can be modified by selectively communicating the bifurcated chambers with either partial removal 261 or by complete removal 262 of the material defining said longitudinal divider 215.

Figure 7C:
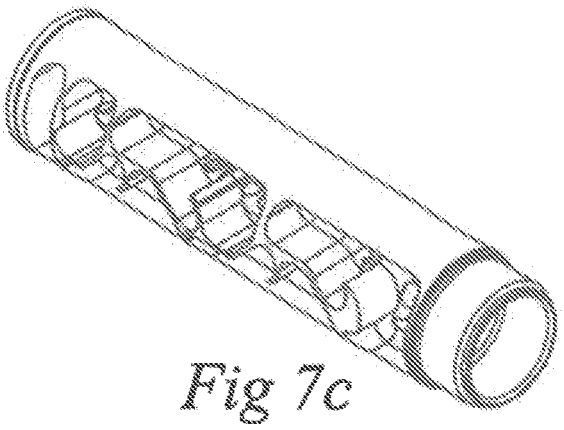
FIG. 7*c* depicts a perspective view of an additional alternate embodiment of a baffle of a parallel path firearm sound suppressor assembly of the present invention.
Figure 7D:
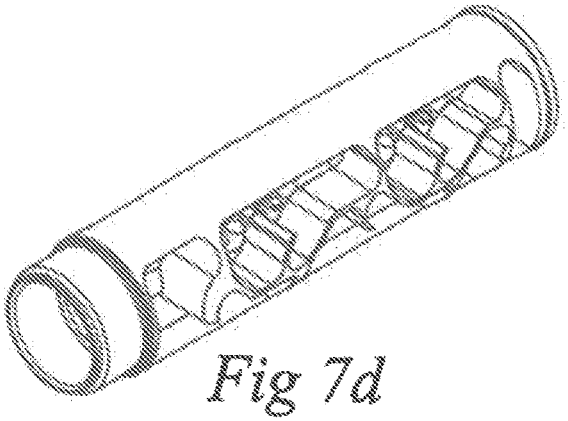
FIG. 7*d* depicts an alternate perspective view of an additional alternate embodiment of a baffle of a parallel path firearm sound suppressor assembly of the present invention.
Figure 7B:
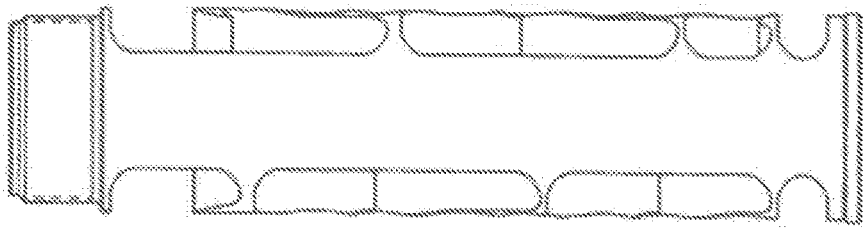
FIG. 7*b* depicts a top view of an additional alternate embodiment of a baffle of a parallel path firearm sound suppressor assembly of the present invention.
Figure 7A:
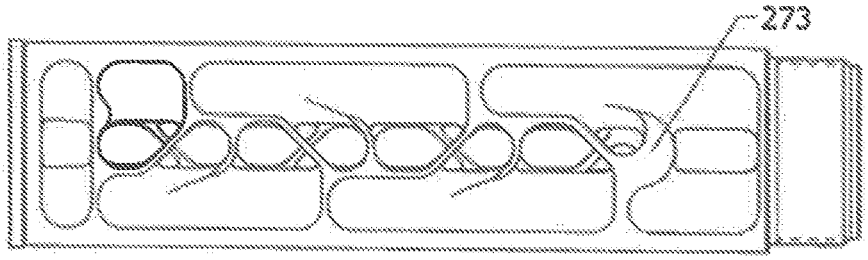
FIG. 7*a* depicts a side view of an additional alternate embodiment of a baffle of a parallel path firearm sound suppressor assembly of the present invention.
Figure 7:
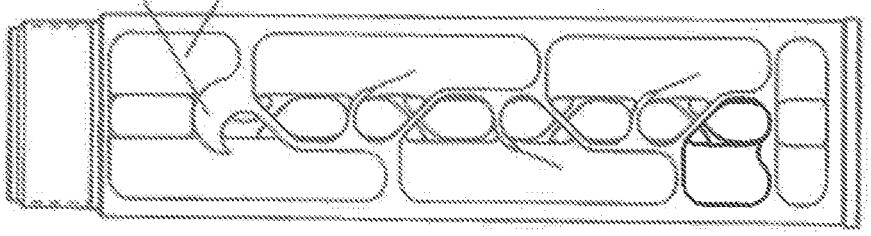
FIG. 7 depicts a side view of an additional alternate embodiment of a baffle of a parallel path firearm sound suppressor assembly of the present invention.

FIG. 7 depicts a side view of an alternate embodiment of baffle member 210 of the present invention comprising longitudinal divider 215. As such, the addition of longitudinal divider 215 can create a plurality of additional embodiments of sound suppressor assembly 100. Further, it is to be observed that baffle geometry need not be identical on both sides of said longitudinal divider 215. As depicted in FIGS. 7*a*-7*d*, baffle geometries 272 and 273 can be opposite on either side of said longitudinal divider 215.

Figure 8:
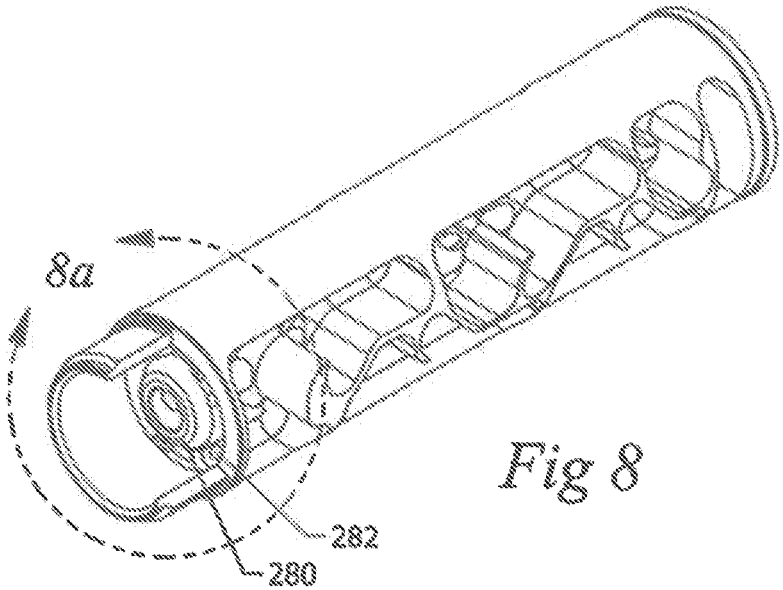
FIG. 8 depicts a perspective view of an alternate embodiment of a baffle of a parallel path firearm sound suppressor assembly of the present invention.
Figure 8A:
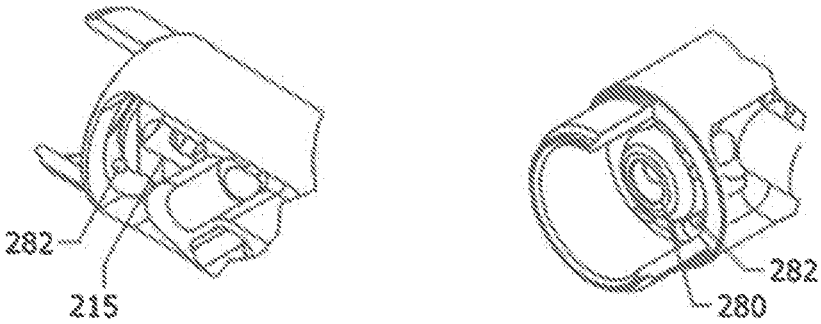
FIG. 8*a* depicts a perspective view of an alternate embodiment of a baffle of a parallel path firearm sound suppressor assembly of the present invention.

FIG. 8 depicts a perspective view of an alternate embodiment of baffle member 210 comprising a blast diffuser 280, wherein said blast diffuser 280 can reduce a concentration of unburned propellant that is introduced directly into bullet pathway hole 104. Blast diffuser 280 diverts solid and gaseous flow away from bullet pathway hole 104, wherein solids are more efficiently directed to deposition features previously described. As illustrated in FIG. 8*a*, a substantially toroidal shaped blast diffuser 280 can divert solids and gases to a plurality of semi-annular passage ways 282 that are formed by diffuser 280 and the cylindrical walls of proximal chamber 141.

Figure 9B:
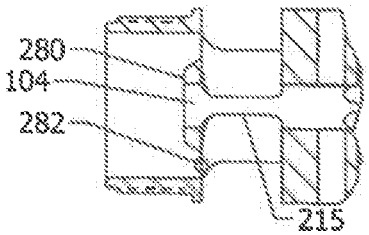
FIG. 9*b* depicts an enhanced cross-sectional view of an alternate embodiment of a baffle of a parallel path firearm sound suppressor assembly of the present invention.
Figure 9A:
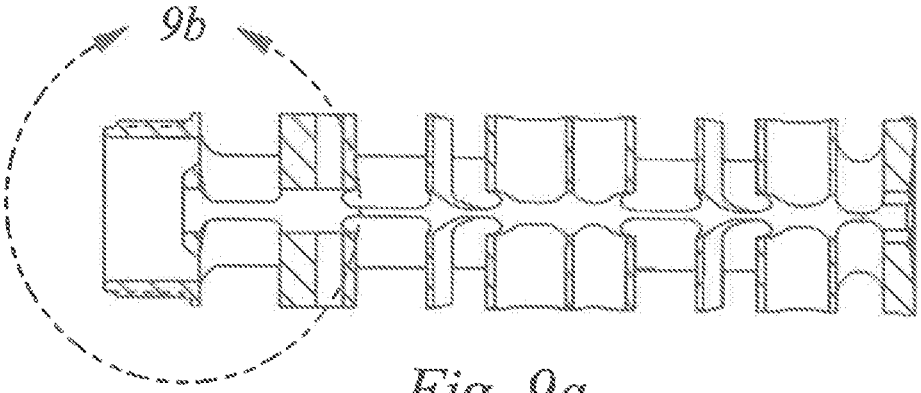
FIG. 9*a* depicts a cross-sectional view of an alternate embodiment of a baffle of a parallel path firearm sound suppressor assembly of the present invention.
Figure 9:
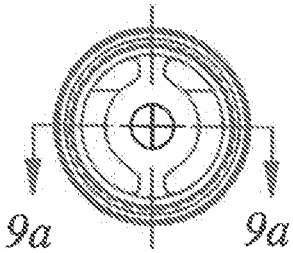
FIG. 9 depicts an end view of an alternate embodiment of a baffle of a parallel path firearm sound suppressor assembly of the present invention.
Figure 10A:
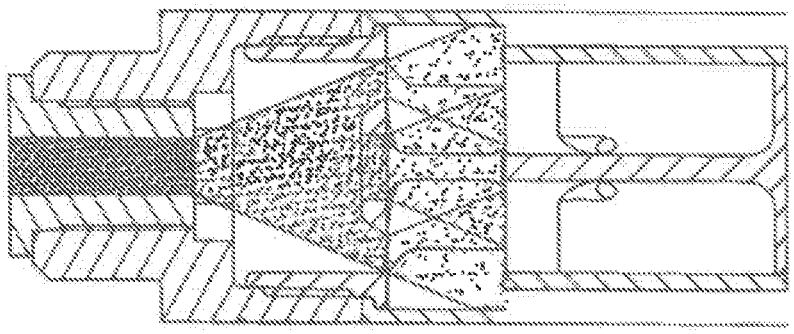
FIG. 10*a* depicts a sectional view of an alternate embodiment of a parallel path firearm sound suppressor assembly of the present invention.
Figure 10:
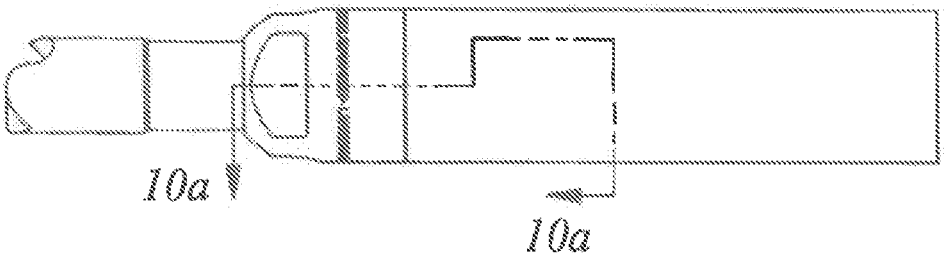
FIG. 10 depicts a side view of an alternate embodiment of a parallel path firearm sound suppressor assembly of the present invention.

FIGS. 9*a* and 9*b* depict longitudinal sectional views of an alternate embodiment of baffle member 210 comprising blast diffuser 280. FIG. 10*a* depicts a longitudinal sectional view of an alternate embodiment of sound suppressor assembly 100 comprising blast diffuser 280, further illustrating an idealized effect of blast diffuser 280 on solids.

Figure 11:
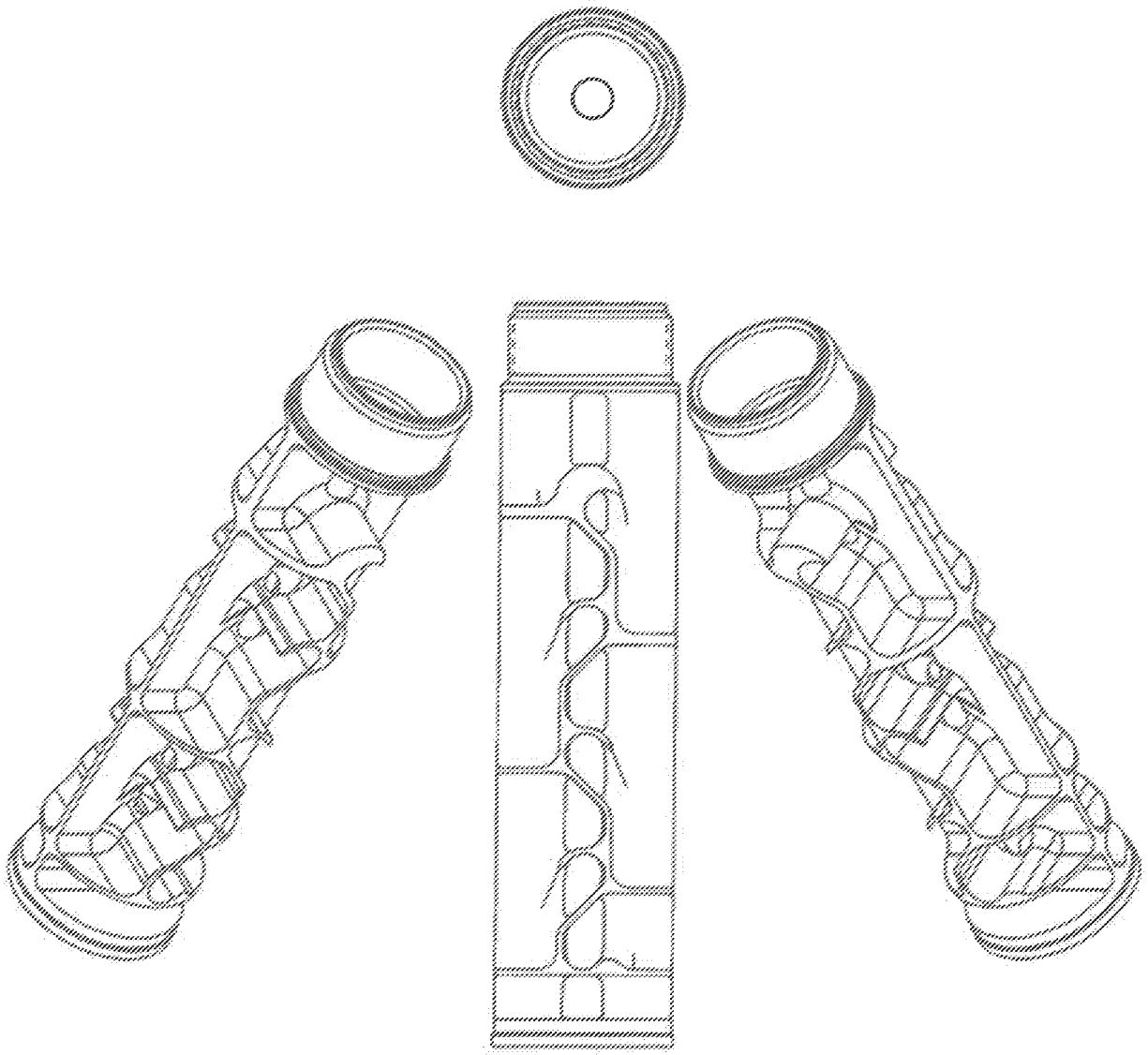
FIG. 11 depicts multiple views of an alternate embodiment of a baffle of a parallel path firearm sound suppressor assembly of the present invention.

FIG. 11 depicts multiple views of an alternate embodiment of sound suppressor assembly 100, comprising another alternate monolithic baffle member, wherein said baffle is manufactured without a semi-circular wall section. As a result, said alternate embodiment of baffle member can be substantially easier to manufacture and have a substantially lighter weight, thus producing a variety of different and desired effects for a specific application of the device.

Figure 12A:
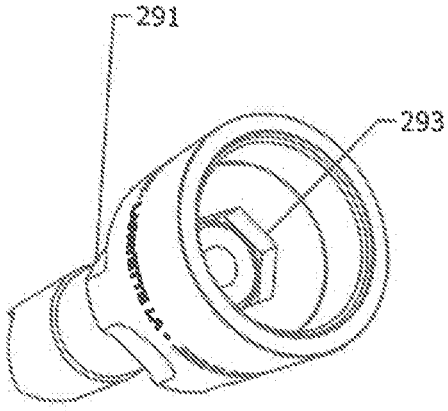
FIG. 12*a* depicts a perspective view of an alternate embodiment of a base member of a parallel path firearm sound suppressor assembly of the present invention comprising a hex broach member.
Figure 12B:
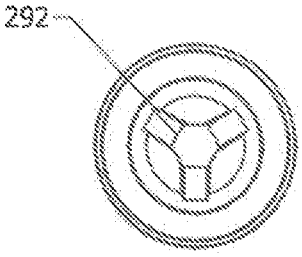
FIG. 12*b* depicts an end view of an alternate embodiment of a parallel path firearm sound suppressor assembly of the present invention comprising a hex broach member.
Figure 12:
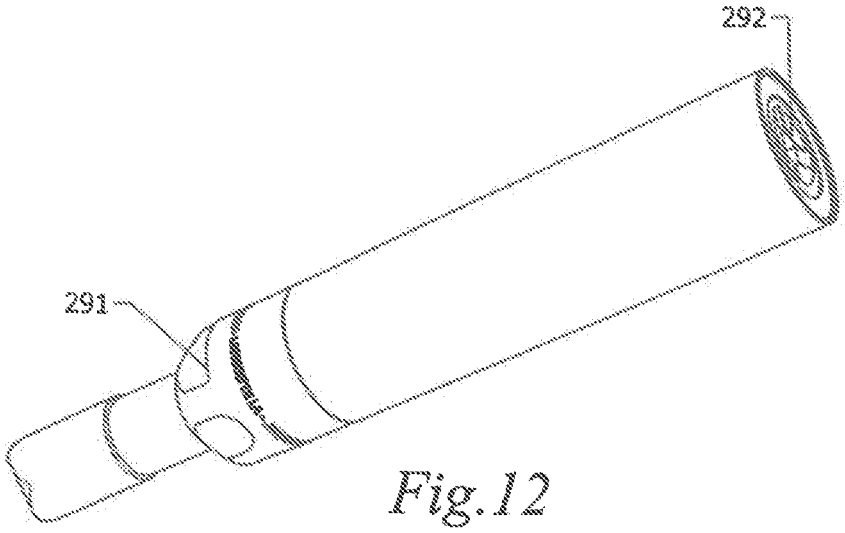
FIG. 12 depicts a perspective view of an alternate embodiment of a parallel path firearm sound suppressor assembly of the present invention comprising a variety of different additional features for use in maintenance of said assembly.

FIG. 12 depicts a perspective view of an alternate embodiment of sound suppressor assembly 100 of the present invention, comprising a variety of different additional features for use in maintenance of the device, such as, for example, a wrench flat 291 on said base 130 and a hex broach 292 on said baffle 110. FIG. 12*a* depicts a perspective view of an alternate embodiment of base member 130 of sound suppressor assembly 100 of the present invention comprising a hex broach member 293 located on an interior of said base 130. FIG. 12*b* depicts an end view of an alternate embodiment of sound suppressor assembly 100 of the present invention comprising a hex broach 292 located on said baffle 110.

In an alternate embodiment, the present invention can comprise a plurality of—typically two—wrench flats 291 that are substantially parallel to at least one other wrench flat 291 and to the longitudinal axis of sound suppressor assembly 100 of the present invention. Said hex broach 292 on baffle 110 is coincident with and coaxial to bullet pathway hole 104 at the distal end of baffle 110 and is generally configured in a size that would not interfere with the bullet in flight. Said hex broach 293 on the distal face of the bottom of the thread bore 136 is coincident with and coaxial to the through hole 105 in the base 130 and is generally configured in a size that would not interfere with the bullet in flight. As a result, said additional features an be used to assist in removing base 130 from a firearm muzzle.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method of suppressing sound and flash from a firearm, comprising:

a) attaching said firearm to a firearm sound suppression apparatus, comprising:

i. a container having a proximal end, a distal end, an outer surface, and a plurality of inner surfaces defining an inner chamber, wherein said proximal end and said distal end each comprise an opening;

b) firing said firearm, wherein firing said firearm releases a projectile and a gas-particle suspension, wherein said gas-particle suspension comprises a plurality of gases and a plurality of solid propellant particles that are suspended within said gas-particle suspension;

c) allowing both said projectile and said gas-particle suspension to exit from said firearm;

d) allowing both said projectile and said gas-particle suspension to enter into and through said opening of said proximal end of said container of said firearm sound suppression apparatus;

e) separating said solid propellant particles from said gas-particle suspension;

f) allowing said gases to flow through said firearm sound suppression apparatus with minimal turbulence and resistance; and g) temporarily detaining said solid propellant particles within said firearm sound suppression apparatus in order to allow a significant quantity of said solid propellant particles to burn and convert to gas, wherein said gas then flows and progresses through said firearm sound suppression apparatus, while any remaining solid propellant particles that did not convert to gas are either ejected through said opening of said distal end of said firearm sound suppression apparatus or adhere to said inner surface of said inner chamber to burn or remain as residue.

2. The method of claim 1, wherein said proximal end opening of said firearm sound suppression apparatus and said distal end opening of said firearm sound suppression apparatus are coaxially aligned, thereby defining a bullet pathway through said firearm sound suppression apparatus.

3. The method of claim 2, further comprising at least one pocket located within said container, wherein said at least one pocket comprises a proximal end having an opening, a distal end, and an inner surface, and wherein said at least one pocket further comprises a cross-sectional area that is substantially smaller than a cross-sectional area of said container.

4. The method of claim 3, wherein said solid propellant particles move through said bullet pathway in a substantially forward direction toward said distal end of said container of said firearm sound suppression apparatus.

5. The method of claim 4, wherein said solid propellant particles move in a direction toward said opening on said proximal end of said at least one pocket.

6. The method of claim 5, wherein said solid propellant particles move into said at least one pocket and are temporarily detained.

7. The method of claim 4, further comprising a blast baffle, wherein said blast baffle comprises a proximal surface and a cross-sectional area that is substantially smaller than a cross-sectional area of said inner chamber of said firearm sound suppression apparatus, wherein said proximal surface of said blast baffle is intended to redirect movement of said solid propellant particles.

8. The method of claim 7, wherein said solid propellant particles impact said proximal surface of said blast baffle and are deflected in a direction substantially toward said opening on said proximal end of said at least one pocket.

9. The method of claim 8, wherein said solid propellant particles move into said at least one pocket and are temporarily detained.

10. The method of claim 7, wherein said solid propellant particles impact said projectile and said solid propellant particles are prevented from entering said bullet pathway.

11. The method of claim 3, wherein said solid propellant particles impact said projectile, and said solid propellant particles are prevented from entering said bullet pathway.

12. The method of claim 3, further comprising at least one subsequent pocket located within said container, wherein said at least one subsequent pocket comprises a proximal end, a distal end, and an inner surface having a cross-sectional area that is substantially smaller than a cross-sectional area of said container, and wherein said proximal end of said at least one subsequent pocket comprises an opening.

13. The method of claim 12, wherein said solid propellant particles move in a direction toward said opening of said proximal end of said at least one subsequent pocket.

14. The method of claim 13, wherein said solid propellant particles move into said at least one subsequent pocket and are temporarily detained.

15. The method of claim 12, wherein said solid propellant particles enter said bullet pathway.

16. The method of claim 15, wherein said solid propellant particles impact said projectile.

17. The method of claim 15, wherein said solid propellant particles exit said bullet pathway.

18. The method of claim 17, wherein said solid propellant particles enter into said proximal end opening of said at least one subsequent pocket.

19. The method of claim 3, further comprising at least one diverter vane located within said container, wherein said diverter vane comprises a proximal side, a distal side, and an edge.

20. The method of claim 19, wherein said diverter vane edge and said inner surfaces of said container define at least one channel for fluid to flow through said channel, wherein said channel further comprises a proximal end having an opening and a distal end having an opening, wherein a cross-sectional area of said proximal end opening is greater than that of a cross-sectional area of said distal end opening.

21. The method of claim 20, wherein said at least one pocket is positioned in a substantially distal manner to said diverter vane edge and said channel within said container of said firearm sound suppression apparatus.

22. The method of claim 21, wherein said gas-particle suspension flows in a substantially forward direction toward said distal end of said container of said firearm sound suppression apparatus.

23. The method of claim 22, wherein said gas-particle suspension is influenced to flow in a direction substantially toward said channel.

24. The method of claim 23, wherein said gas-particle suspension flowing toward said channel accelerates through said channel in a direction substantially toward said opening on said proximal end of said at least one pocket.

25. The method of claim 24, wherein said gas-particle suspension accelerating through said channel is influenced to move in a direction substantially away from said opening on said proximal end of said at least one pocket.

26. The method of claim 25, wherein an inertial force of said solid propellant particles that are suspended within said gas-particle suspension exceeds a centripetal force that retains said particles within said gas-particle suspension.

27. The method of claim 26, wherein said solid propellant particles move out of said gas-particle suspension.

28. The method of claim 27, wherein said solid propellant particles move in a direction substantially toward said proximal end of said at least one pocket.

* * * * *